US007338348B2

(12) United States Patent
Melvin et al.

(10) Patent No.: US 7,338,348 B2
(45) Date of Patent: Mar. 4, 2008

(54) DUST COLLECTION SYSTEM FOR A BELT SANDER

(75) Inventors: Jason R. Melvin, Baltimore, MD (US); Michael J. Walstrum, Columbia, MD (US); Carl F. Merhar, III, Baltimore, MD (US); Gregory A. Rice, Aberdeen, MD (US); John McKibben, Dallastown, PA (US); Danielle V. Gayle, Baltimore, MD (US); Jonah Myerberg, Boston, MA (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/652,181

(22) Filed: Aug. 29, 2003

(65) Prior Publication Data

US 2005/0048883 A1 Mar. 3, 2005

(51) Int. Cl.
*B24B 23/00* (2006.01)

(52) U.S. Cl. ..... 451/28; 451/355

(58) Field of Classification Search ..... 451/28, 451/344, 355, 57, 356, 360
See application file for complete search history.

(56) References Cited

U.S. PATENT DOCUMENTS

| | | | | |
|---|---|---|---|---|
| 2,991,595 | A | | 7/1961 | Addis |
| 3,180,063 | A | | 4/1965 | Burrows et al. |
| 3,391,499 | A | | 7/1968 | Batson |
| 3,535,829 | A | | 10/1970 | Dudek |
| 3,566,548 | A | | 3/1971 | Beckering et al. |
| 3,902,284 | A | | 9/1975 | Hastily |
| 3,938,283 | A | | 2/1976 | Keith, Jr. |
| 4,058,936 | A | | 11/1977 | Marton |
| 4,118,897 | A | | 10/1978 | Martin |
| 4,192,104 | A | | 3/1980 | Patenaude |
| 4,192,390 | A | | 3/1980 | Wanner et al. |
| 4,334,390 | A | | 6/1982 | Sumerau |
| 4,381,628 | A | * | 5/1983 | Dicke ..... 451/356 |
| 4,741,130 | A | * | 5/1988 | Tano et al. ..... 451/38 |
| 4,753,047 | A | * | 6/1988 | Yoshikawa et al. ..... 451/331 |
| 4,754,579 | A | * | 7/1988 | Batt ..... 451/355 |
| 4,758,023 | A | | 7/1988 | Vermillion |
| 4,841,681 | A | * | 6/1989 | Dickson ..... 451/37 |
| 4,967,516 | A | | 11/1990 | Hoshino et al. |
| 5,245,797 | A | * | 9/1993 | Milkie ..... 451/354 |
| 5,341,605 | A | | 8/1994 | Tasikas |
| 5,349,752 | A | | 9/1994 | Stirm |

(Continued)

FOREIGN PATENT DOCUMENTS

| | | |
|---|---|---|
| DE | 1274916 | 8/1968 |

(Continued)

*Primary Examiner*—Jacob K. Ackun, Jr.
(74) *Attorney, Agent, or Firm*—Michael P. Leary; Charles E. Yocum; Adan Ayala

(57) ABSTRACT

An electrically powered belt sander comprising a housing, a dust flow path defined by the housing, a motor mounted in the housing at a first location and having an output shaft, a fan connectable to the motor output shaft and rotateably mounted in the housing at a second location a distance from the motor output shaft, a belt connectable between the motor output shaft and the fan whereby the rotation of the motor output shaft drives the rotation of the fan, and a damper located in the dust flow path and operable for blocking the dust flow path.

13 Claims, 20 Drawing Sheets

U.S. PATENT DOCUMENTS

| | | | |
|---|---|---|---|
| 5,419,737 | A | 5/1995 | Brazell et al. |
| 5,467,835 | A | 11/1995 | Obermeier et al. |
| 5,595,531 | A | 1/1997 | Niemela et al. |
| 5,698,500 | A | 12/1997 | Baranski et al. |
| 5,815,934 | A | 10/1998 | Eichberger et al. |
| 5,833,524 | A | 11/1998 | Satoh et al. |
| 5,878,607 | A | 3/1999 | Nunes et al. |
| 5,974,626 | A | 11/1999 | Wood |
| 6,159,085 | A | 12/2000 | Hara |
| 6,224,471 | B1 | 5/2001 | Clowers et al. |
| 6,514,131 | B1 | 2/2003 | Reich et al. |
| 6,785,932 | B2 * | 9/2004 | Bone ..... 15/334 |
| 2003/0188396 | A1 * | 10/2003 | Hitzelberger et al. ..... 15/351 |
| 2004/0248507 | A1 * | 12/2004 | Brazell et al. ..... 451/361 |

FOREIGN PATENT DOCUMENTS

| | | |
|---|---|---|
| DE | 35 35 636 A1 | 4/1987 |
| DE | 3542466 | 6/1987 |
| DE | 41 21 256 A1 | 1/1993 |
| DE | 19847624.8 | 10/1997 |
| DE | 198 51 064 A1 | 6/1999 |
| GB | 1 058 656 A | 2/1967 |

* cited by examiner

DUST COLLECTION SYSTEM FOR A BELT SANDER

FIELD OF THE INVENTION

The present invention generally relates to electric powered portable sanders having a dust collection system. More particularly it relates to portable belt sanding power tools.

BACKGROUND OF THE INVENTION

All sanding tools create a large amount of dust. In particular, a belt sander creates large quantities of wood dust both in the air and on the surface of the workpiece. Because of this most electric sanders employ some sort of dust collection system. These dust collection systems typically use a fan driven directly by the motor to create a suction for the dust collection system. The dust collection fan may be half of a two-sided or double sided fan (the other half cooling the motor) or it may be mounted on one end of a motor opposite to the other end bearing a motor cooling fan. In either case, dust laden air is deliberately routed past the motor and dust leakage into the motor is aggravated.

Furthermore, these systems tend to clog due to the tortuous flow path though and around narrow channels, small chokes, and tight corners. Clogging of the dust removal flow path not only degrades or stops dust collection, it can also foul the dust fan, load down the motor, and reduce cooling air to the sander motor, which may damage the motor. Another drawback of those systems employing a main motor fan to collect dust is that, when the user would prefer to work without dust collection, such systems cannot be deliberately shut off, because of the need to cool the motor. Simply leaving off the dust receptacle is often impractical since a stream of dust laden air would then exhaust at or near the user.

In some sanders such as the Black & Decker model 4028, a second, separately controllable electric motor and fan is provided for the dust collection system. The inclusion of a separate dust collection motor, however, drives up the size, weight, and cost of the sander.

Accordingly, it is an object of the present invention to provide an improved sander that provides a dust collection system wherein an obstruction of the dust removal path does not reduce cooling air flow to the motor. It is another object of the present invention to provide a sander dust collection system that allows for operation of the sander with the dust collection airflow deliberately blocked or stopped.

Another problem with current sander designs is the common use of so called "flag bag" dust receptacles. Flag bag receptacles are fabric dust bags usually suspended from a support over the top of the sander or set off to one side. The height of the bag and the location create problems with tool access to and with user vision of the workpiece. As the bag fills with dust the added weight can unbalance a type of portable tool that is often already top heavy. Furthermore, as it fills the bag will often droop down into dragging contact with the workpiece, which can damage the bag or pull the sander from the intended track.

Accordingly it is another objective of the present invention to provide a dust receptacle that will not droop or sag when loaded and which can be securely mounted low down and behind the main body of the belt sander.

Still another problem with current sanders is that the inlet of the dust receptacle and the dust outlet of the tool usually rely on a simple friction or taper fit to hold the two conical or tubular components together. Without a positive locking mechanism to hold the two parts together, it is possible for the two parts to separate during use, resulting in dust laden air blowing out of the suddenly exposed dust outlet.

Accordingly it is still another objective of the present invention to provide a secure mechanical engagement between the improved dust receptacle and to provide a positive locking mechanism to prevent the inadvertent disengagement of the dust receptacle from the sander.

SUMMARY OF THE INVENTION

In one preferred form, the present invention provides a sander with a separate dust collection fan driven off the main motor, but not directly connected to it. This dust fan can be located away from the motor for a more compact tool and improved dust removal airflow. Moreover it can be spun at a speed independent of the motor armature and more efficient for dust collection. In a preferred embodiment the dust fan is powered from the main motor by means of a belt drive, but a gear train could also be used.

The separate fan system can be turned off by either of two convenient methods. A user operable damper may be provided in the dust flow path to interrupt the airflow even though the fan continues to spin. Unlike the single motor single fan designs, this will have no adverse effect on cooling the motor. Alternatively, the dust fan can be disconnected from the motor, thus permanently disabling the dust collection system, unloading the motor, and decreasing tool noise.

In another preferred embodiment, the sander is provided with a semi-rigid dust cassette that is mounted low and rearward of the sander. Thus located, it reduces tool access and user vision problems. Moreover, the dust fan does not have to blow dust upward into a fabric sack that is held open only by the air pressure within. Additionally, so located and constructed the preferred dust receptacle/cassette reduces the access, vision, and balance problems associated with the "flag bag" type receptacles.

In the preferred embodiment, the dust receptacle comprises a flexible part of rubber like material. Thus constructed, the flexible part of the dust receptacle can be deformed in order to facilitate alignment and engagement of the dust receptacle when mounting it to the sander.

In another aspect of the preferred embodiment, secure engagement is further enhanced by the provision of a positive locking mechanism for holding together the dust outlet of the sander housing and the inlet of the dust receptacle. The locking mechanism comprising a movable collar on the outlet duct of the housing which lockably engages tabs on the inlet nozzle of the dust receptacle.

Further areas of applicability of the present invention will become apparent from the detailed description provided hereinafter. It should be understood that the detailed description and specific examples, while indicating a preferred embodiment of the invention, are intended for purposes of illustration only and are not intended to limit the scope of the invention.

BRIEF DESCRIPTION OF THE DRAWINGS

A sander according to the present invention will now be described by way of example, with reference to the accompanying drawings in which.

DETAILED DESCRIPTION OF THE PREFERRED EMBODIMENT

Figure 1:
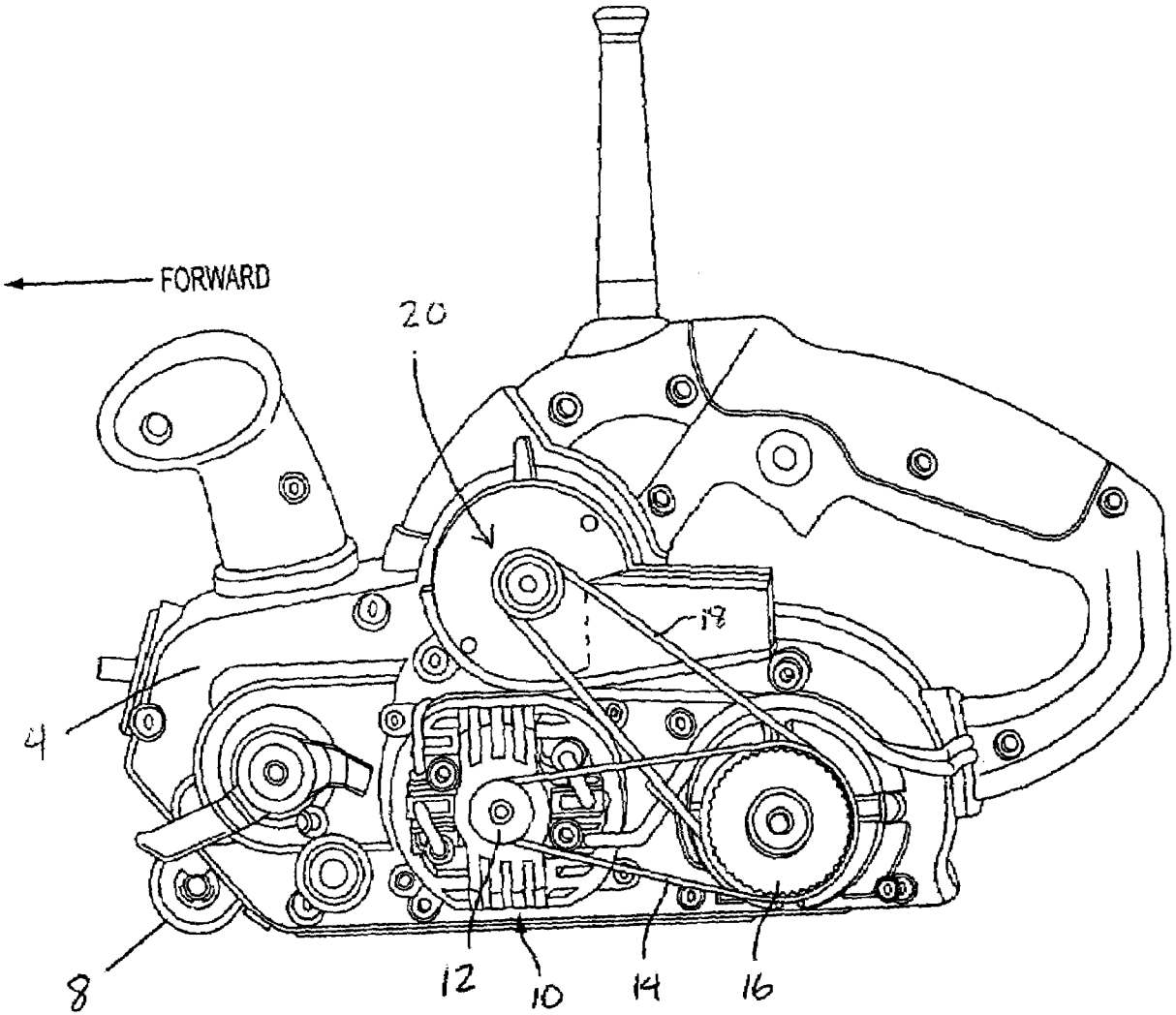
FIG. 1 is an elevation view of a belt sander; according to the present invention, and with part of the exterior housing removed.

With reference to the accompanying FIGS. 1, 2, 3, and 4, motor assembly 10 is transversely mounted between the rearwardly located drive roller 9 and the front roller assembly 8. The motor output shaft, which extends through an opening in gear case cover 4, ends in drive pulley 12.

Drive pulley 12 pulls drive belt 14. Drive belt 14 turns driven pulley 16. Driven pulley 16, through gearing not shown, turns rear drive roller 9. A second portion of driven pulley 16 pulls dust collection fan belt 18, which powers a dust collection fan 20 that is located on an upper portion of gear case cover 4. In the preferred embodiment shown, fan belt 18 is an o-ring.

Figure 2:
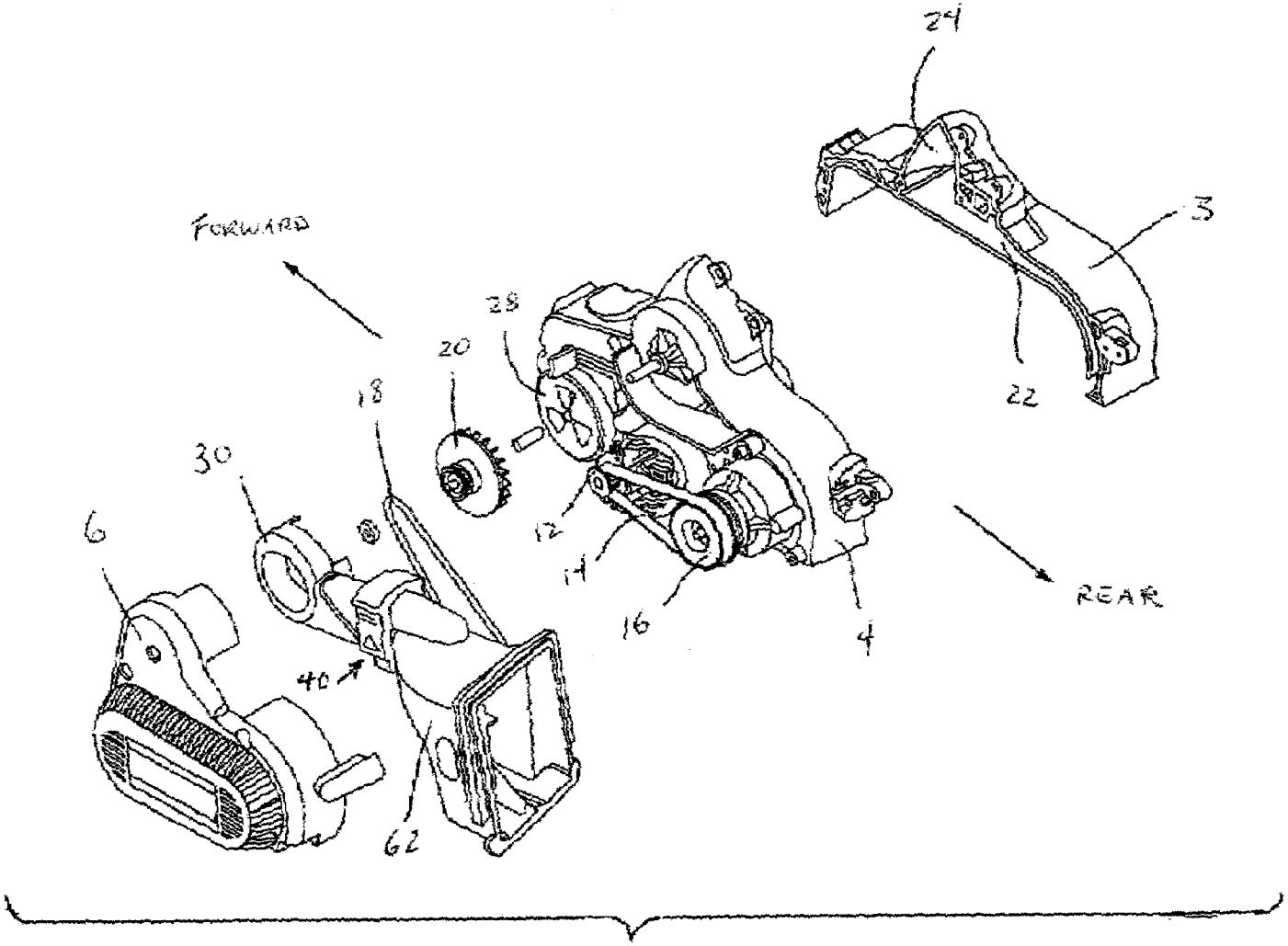
FIG. 2 is a simplified exploded view of the belt sander of FIG. 1.
Figure 3:
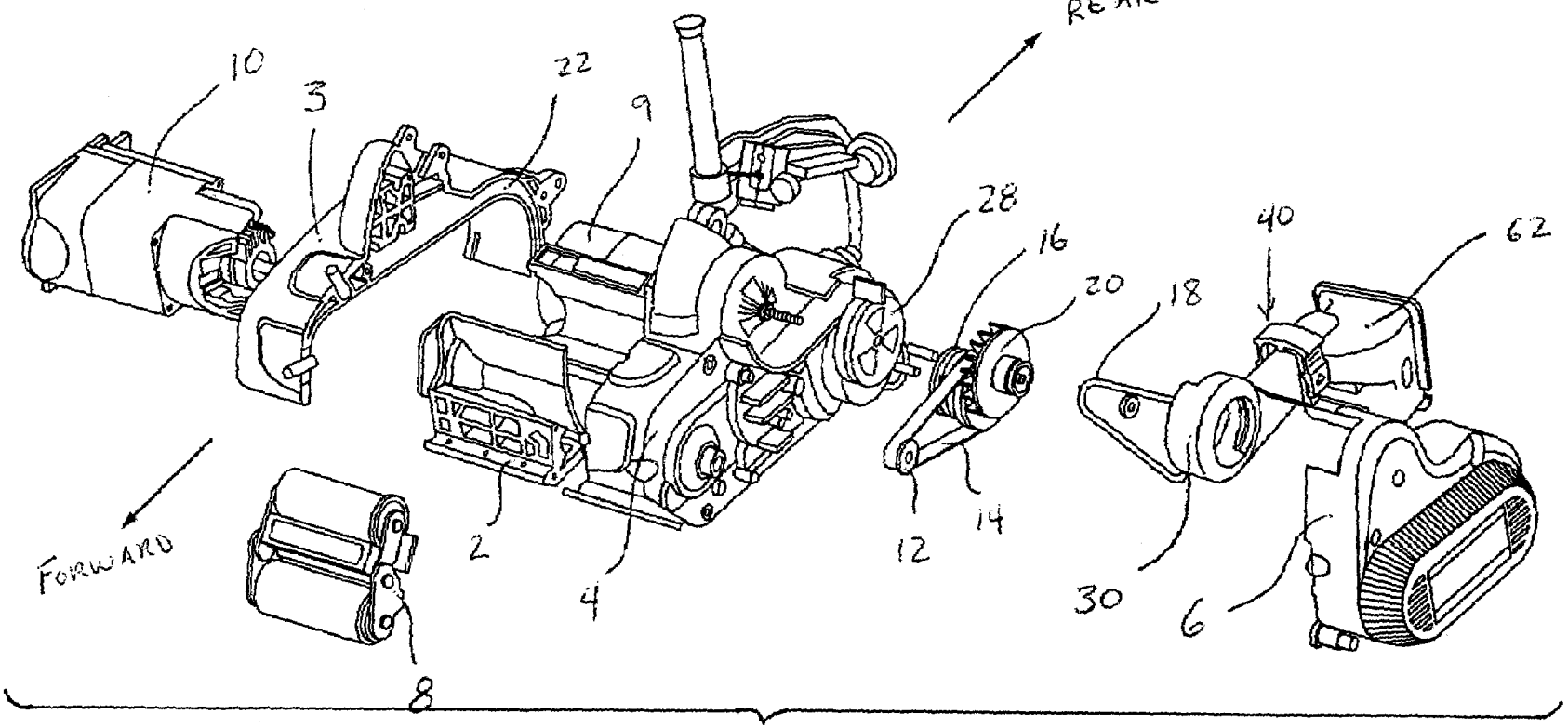
FIG. 3 is another simplified exploded view of the belt sander of FIG. 1.
Figure 4:
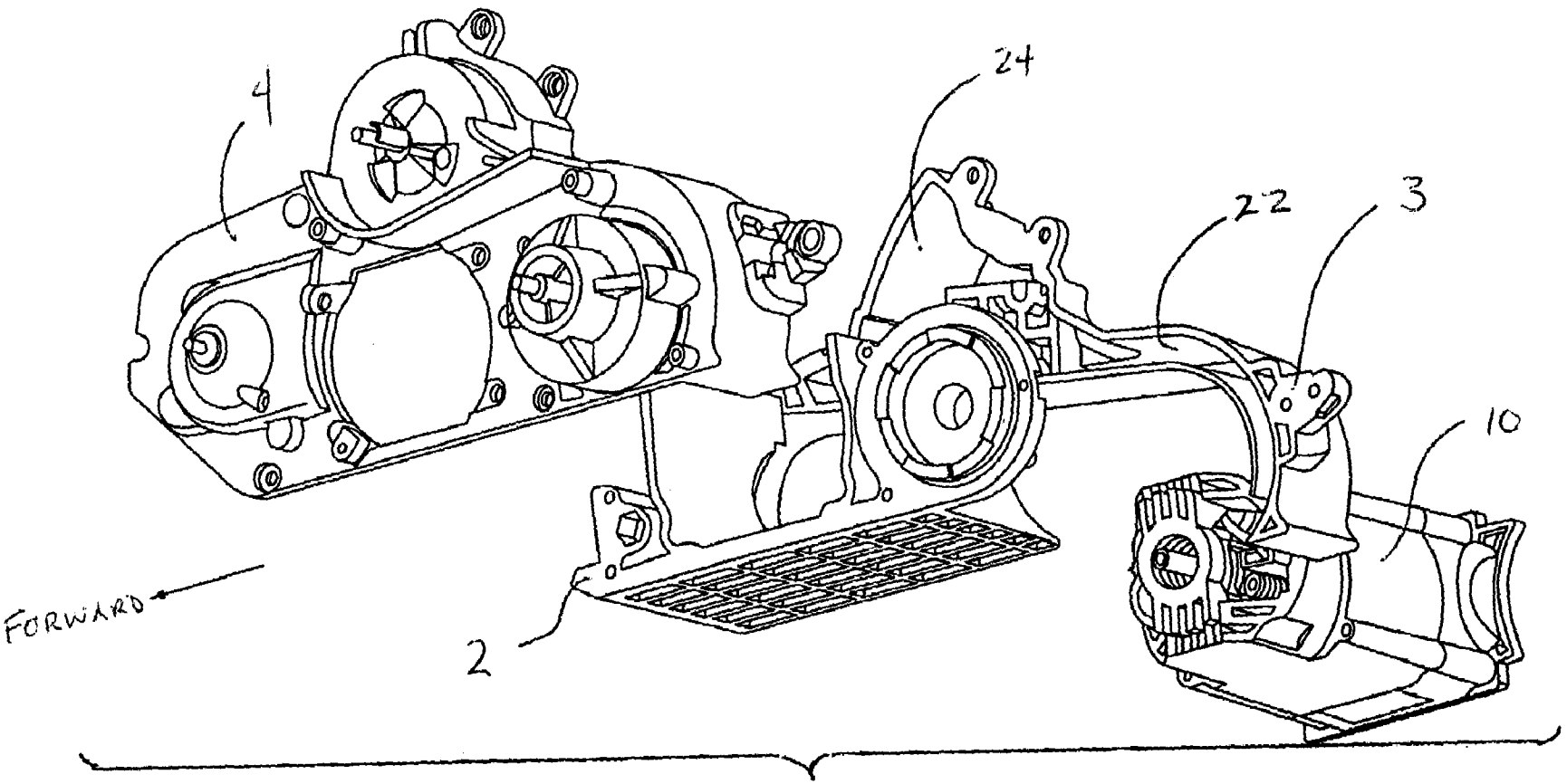
FIG. 4 is another simplified exploded view of the belt sander of FIG. 1.

With particular reference to FIGS. 2-4, the left-hand/outward side of the gear case cover 4 is covered by belt cover/housing 6, which encloses the pulleys 12 and 16 and belts 14 and 18. Completing the frame/superstructure of the sander is the right side housing 3.

Figure 5:
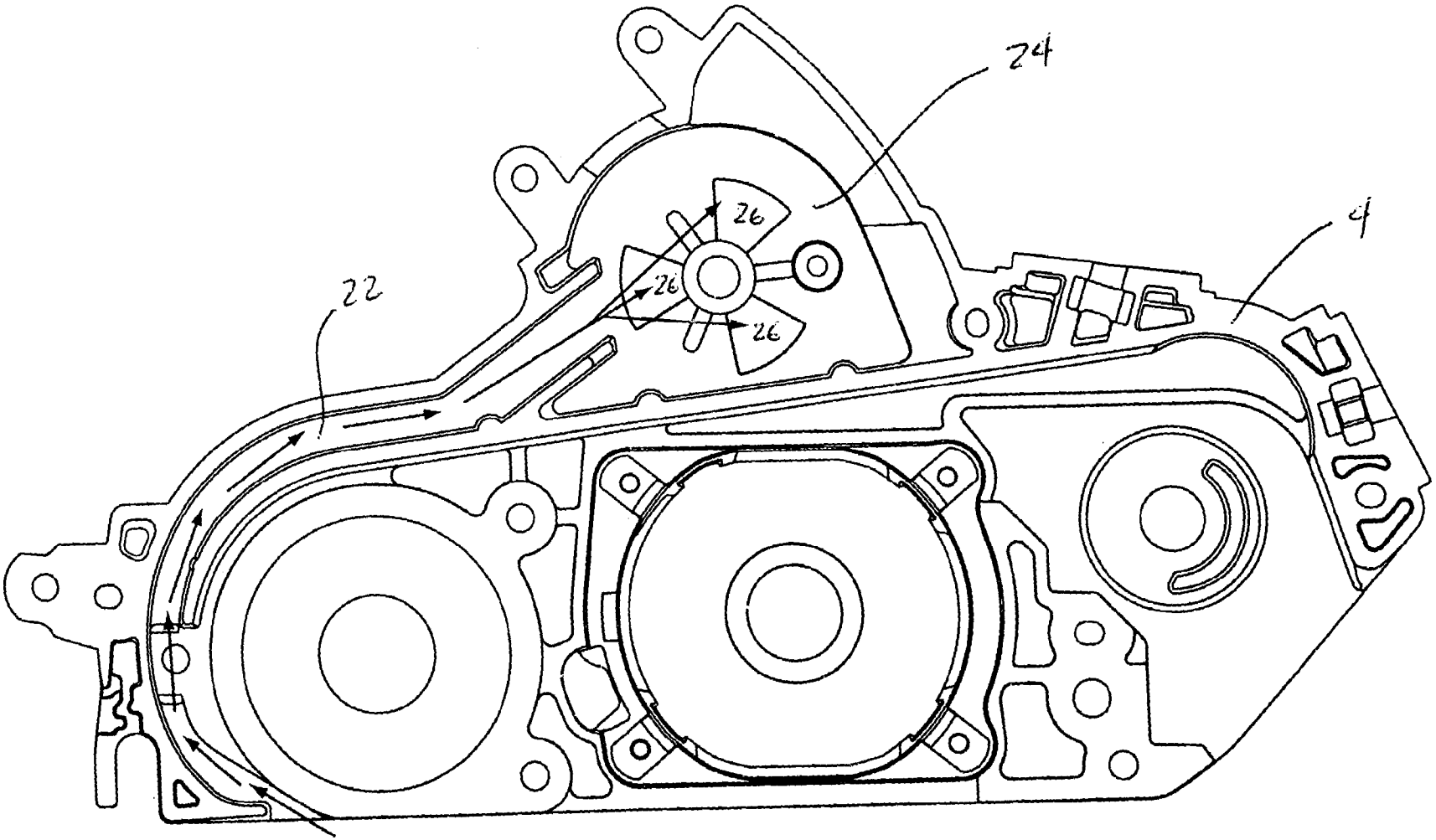
FIG. 5 is a right side elevation view of the gear case of the belt sander of FIG. 1.
Figure 6:
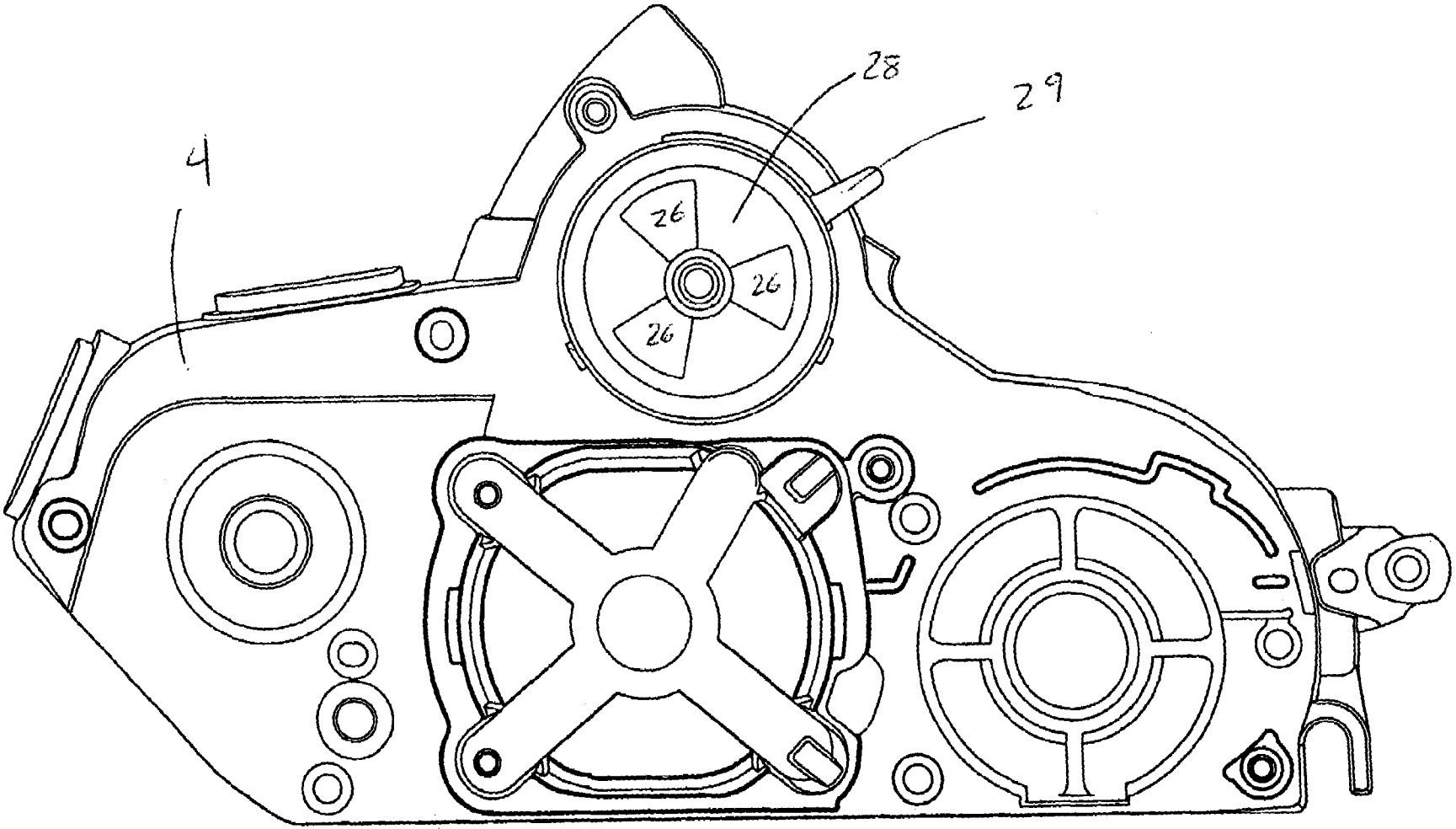
FIG. 6 is a left side elevation view of the gear case of FIG. 5.
Figure 7:
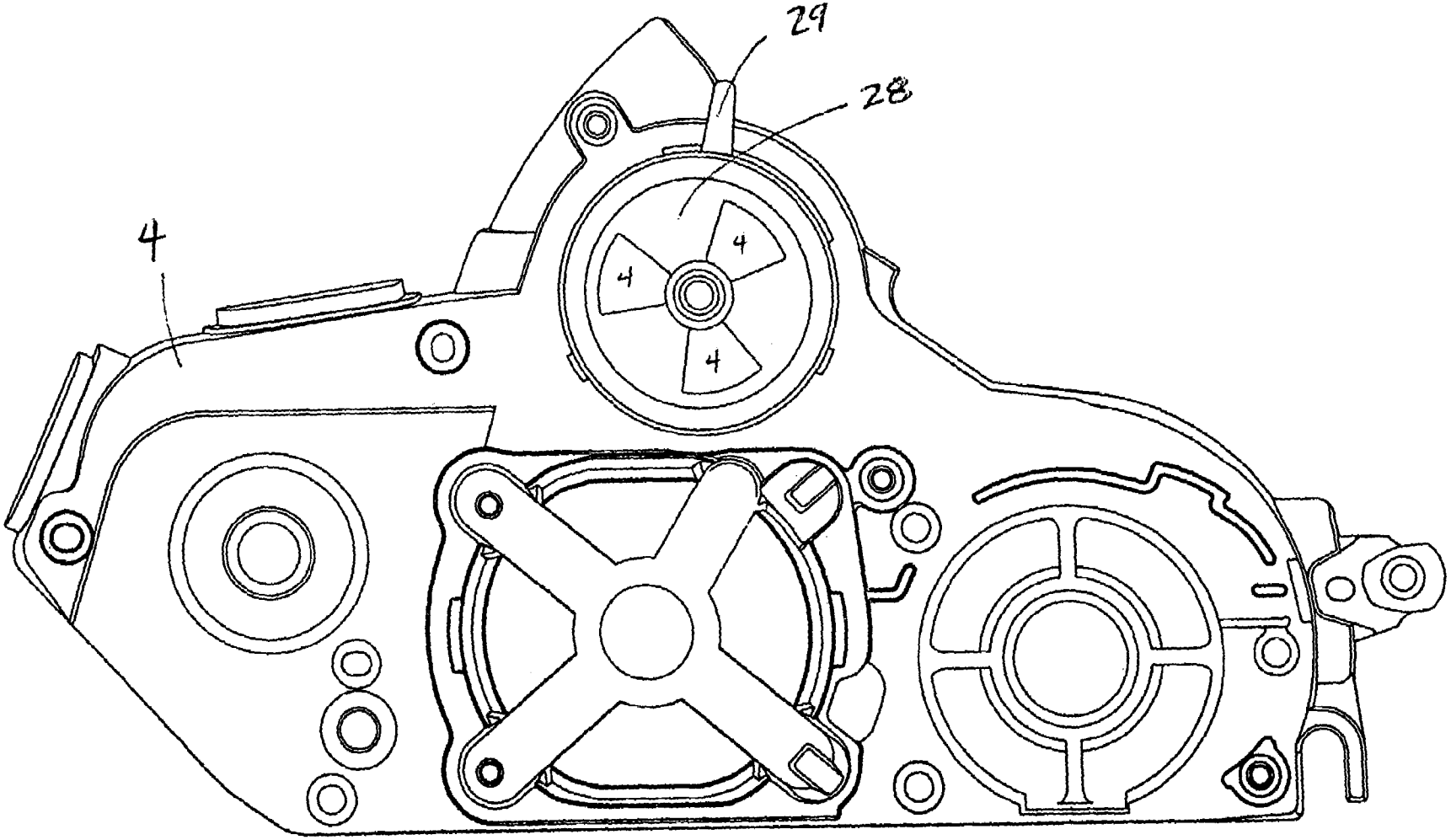
FIG. 7 is another side elevation view of the gear case of FIG. 5.
Figure 8:
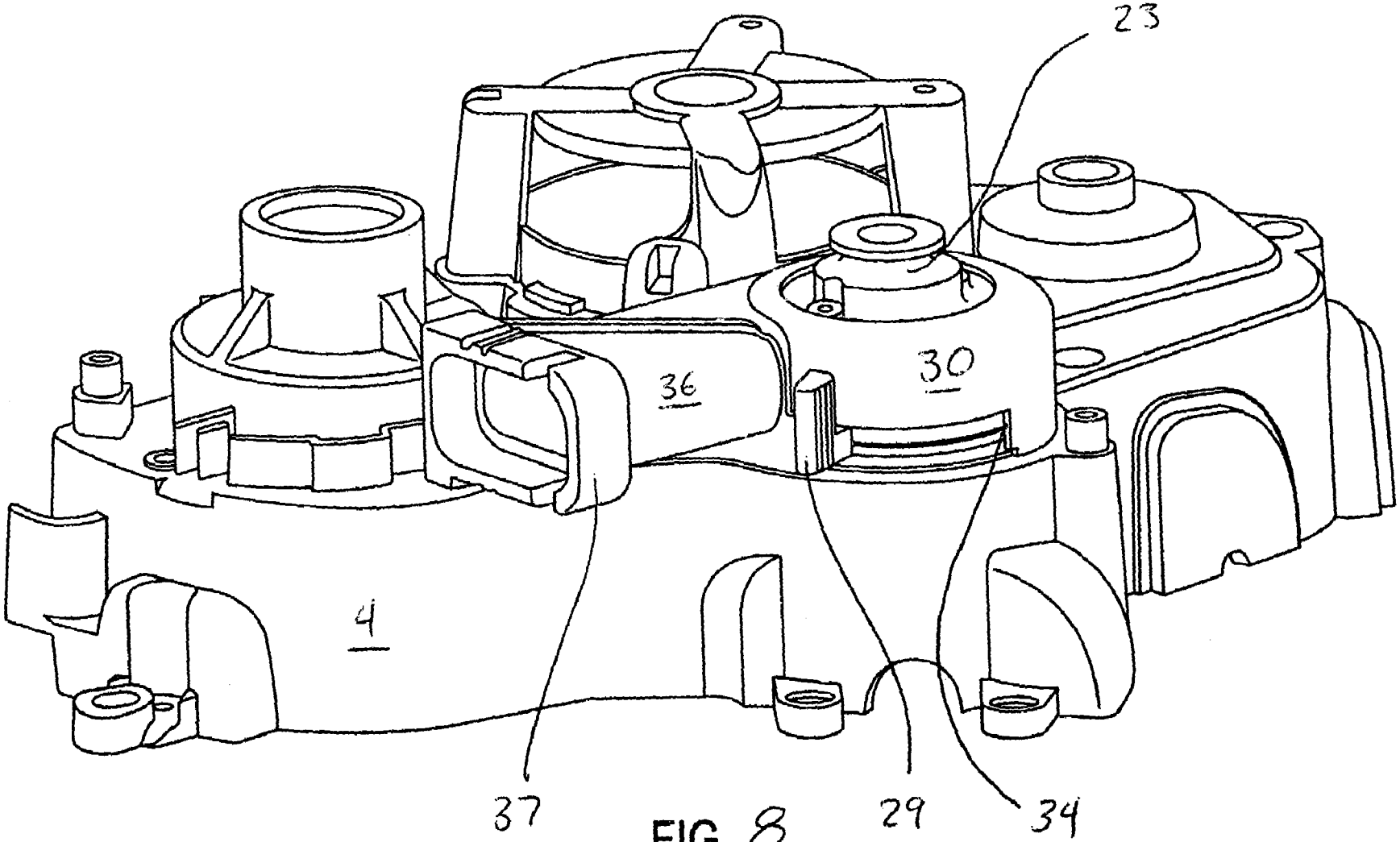
FIG. 8 is a perspective view of the gear case of the belt sander of FIG. 1.
Figure 9:
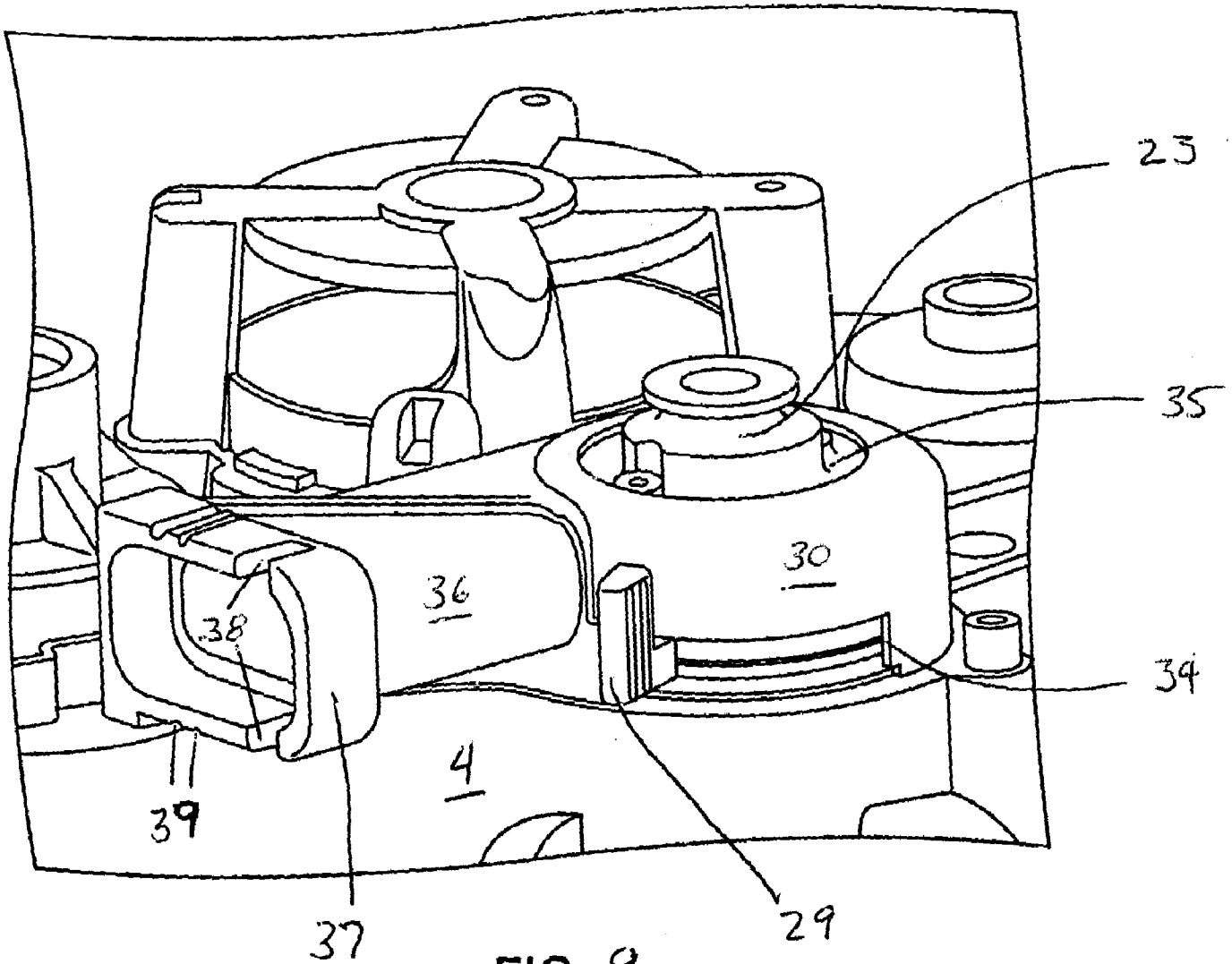
FIG. 9 is a close up perspective view of portions of the gear case of FIG. 8.
Figure 10:
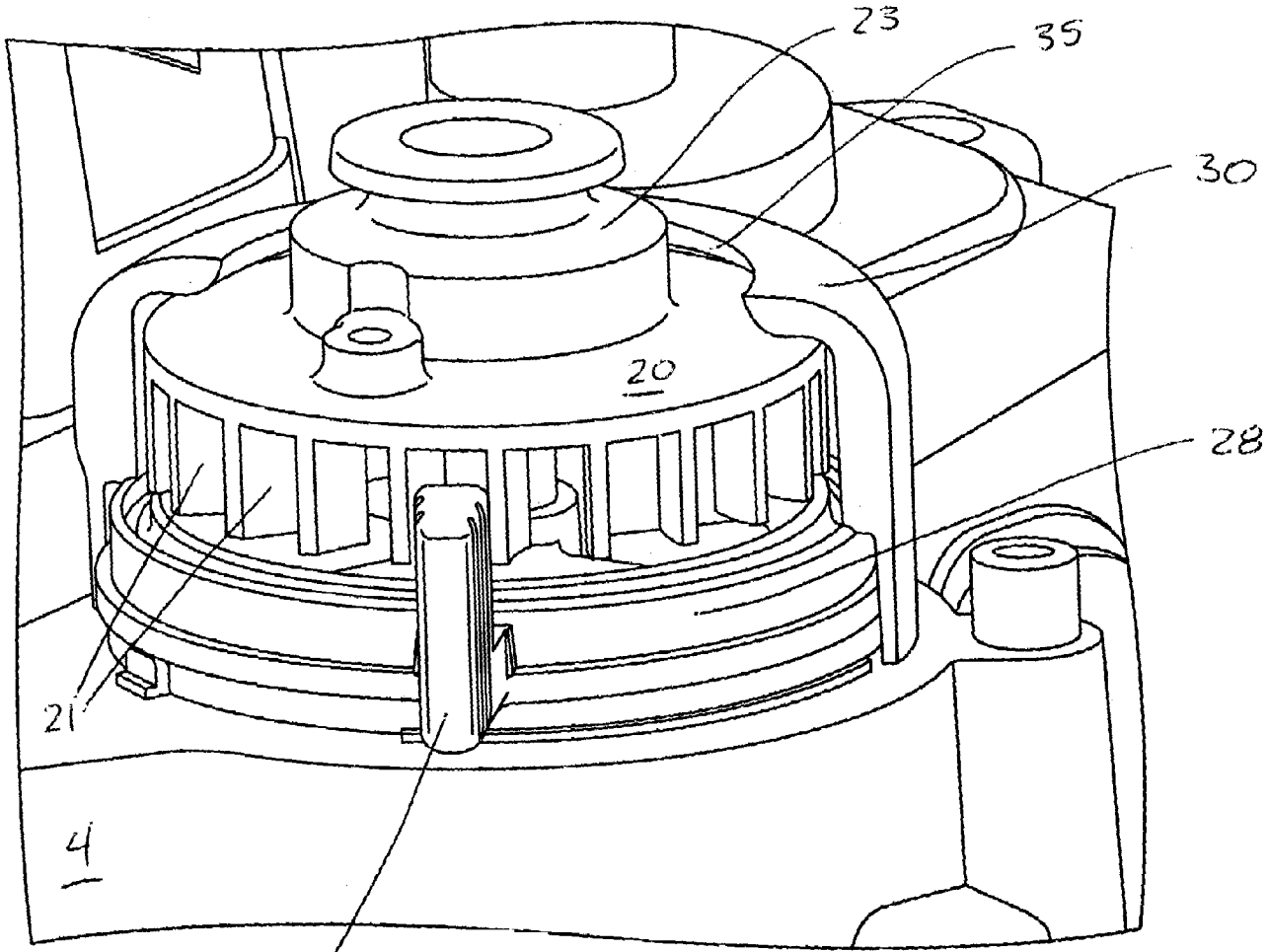
FIG. 10 is a partial cutaway and close-up perspective view of details of the dust fan of the belt sander of FIG. 9.
Figure 11:
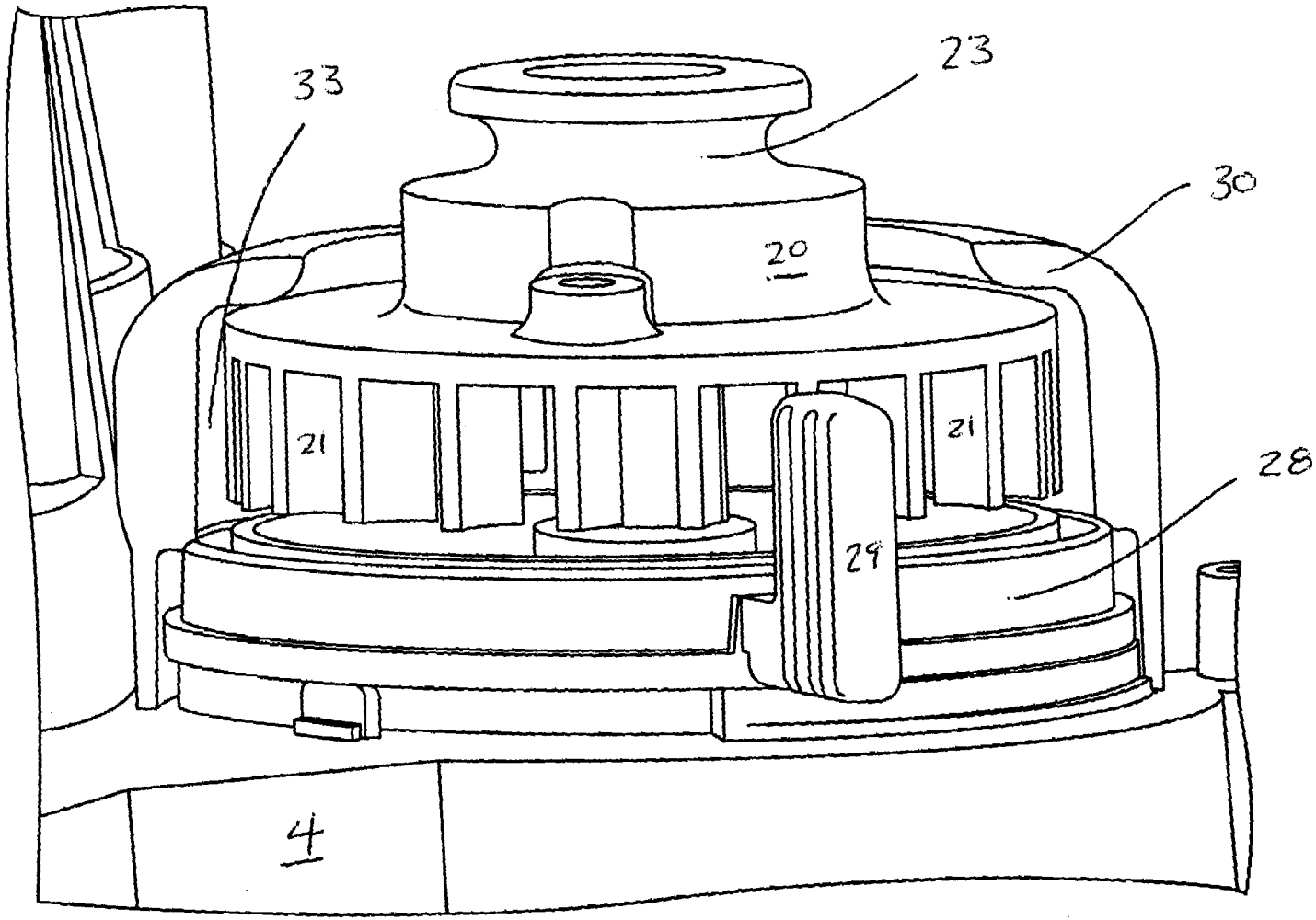
FIG. 11 is a cutaway elevation view of the dust fan of FIG. 10.
Figure 12:
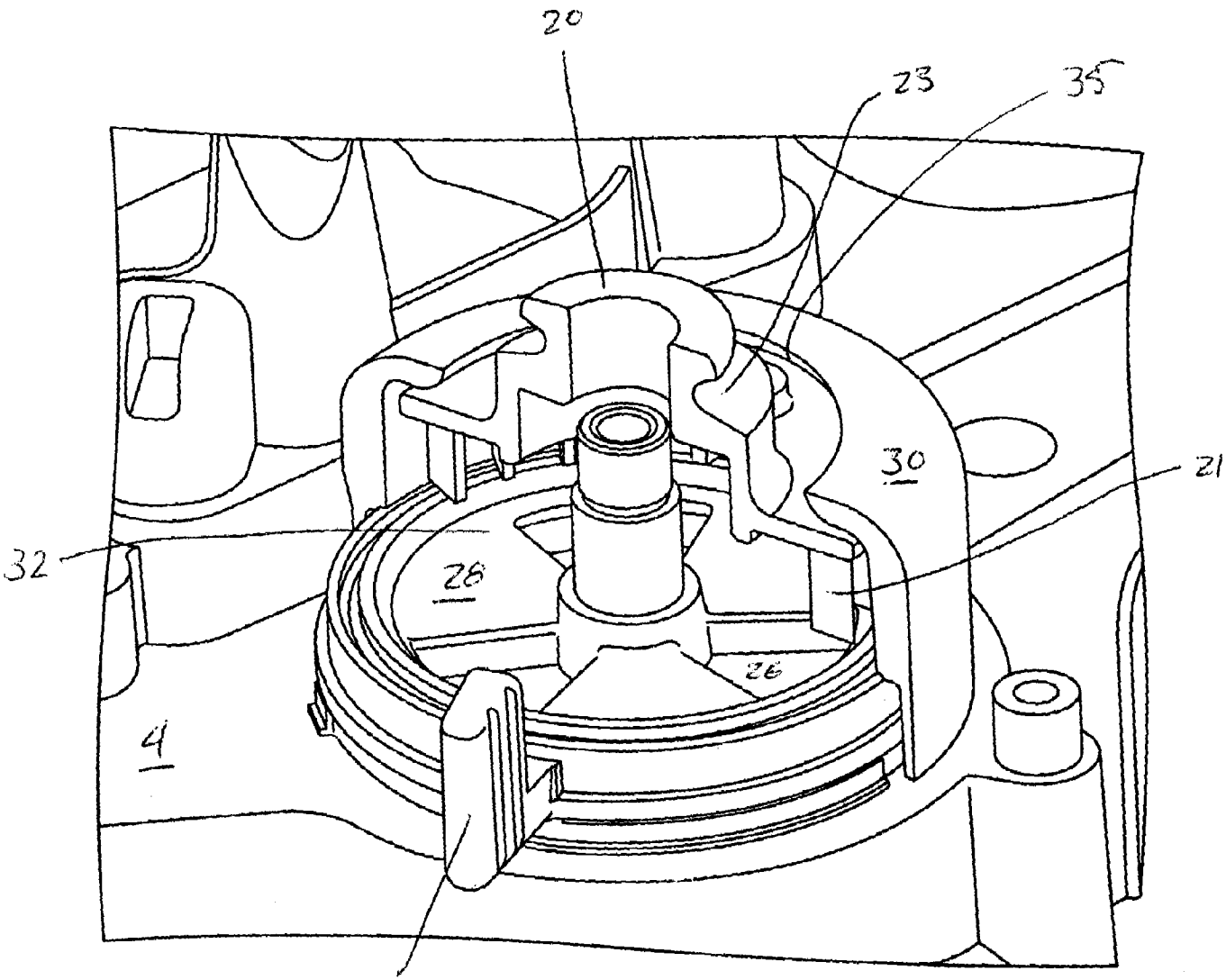
FIG. 12 is a further cutaway perspective view of the dust fan of FIG. 10.
Figure 13:
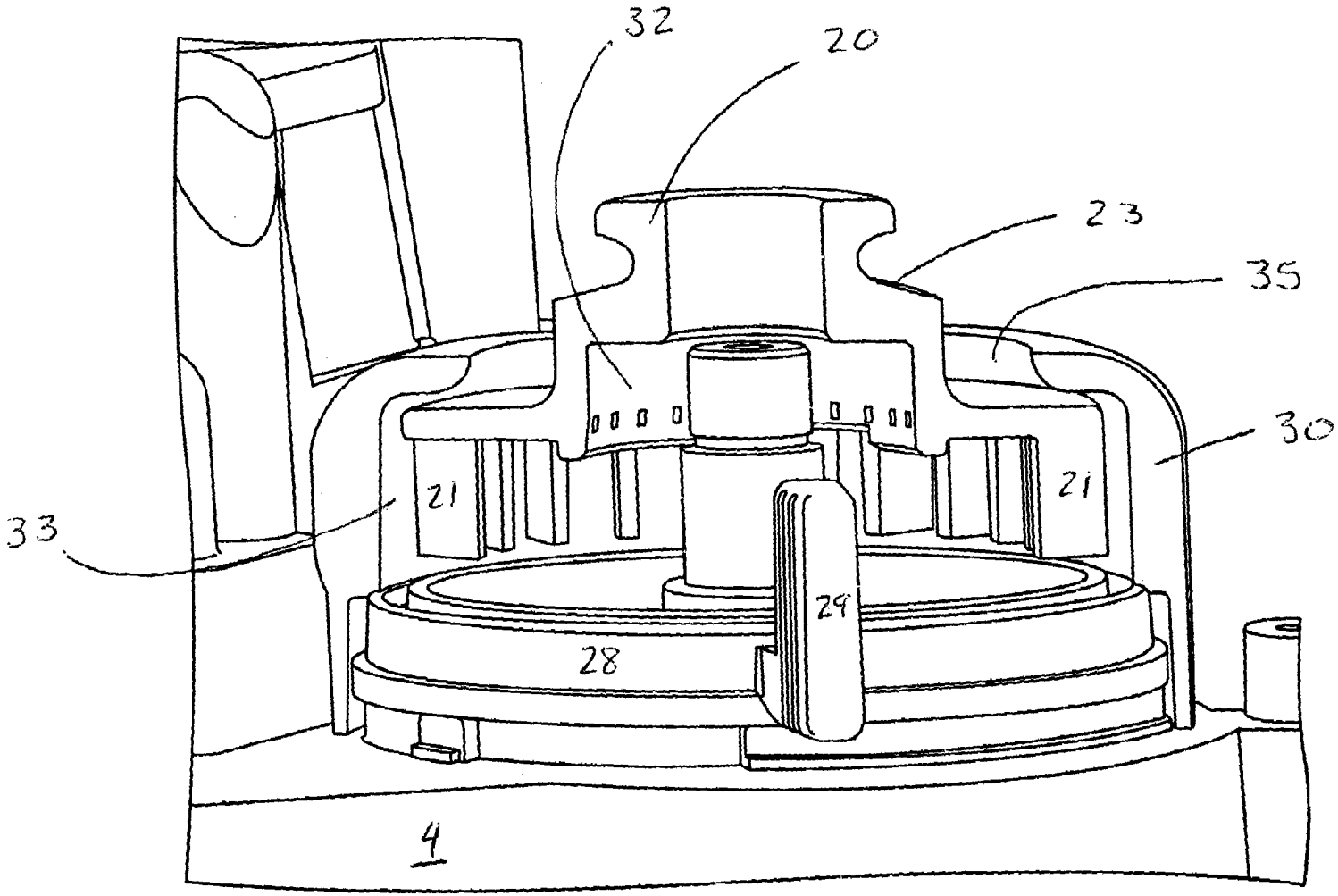
FIG. 13 is a cutaway elevation view of the dust fan of FIG. 12.
Figure 14:
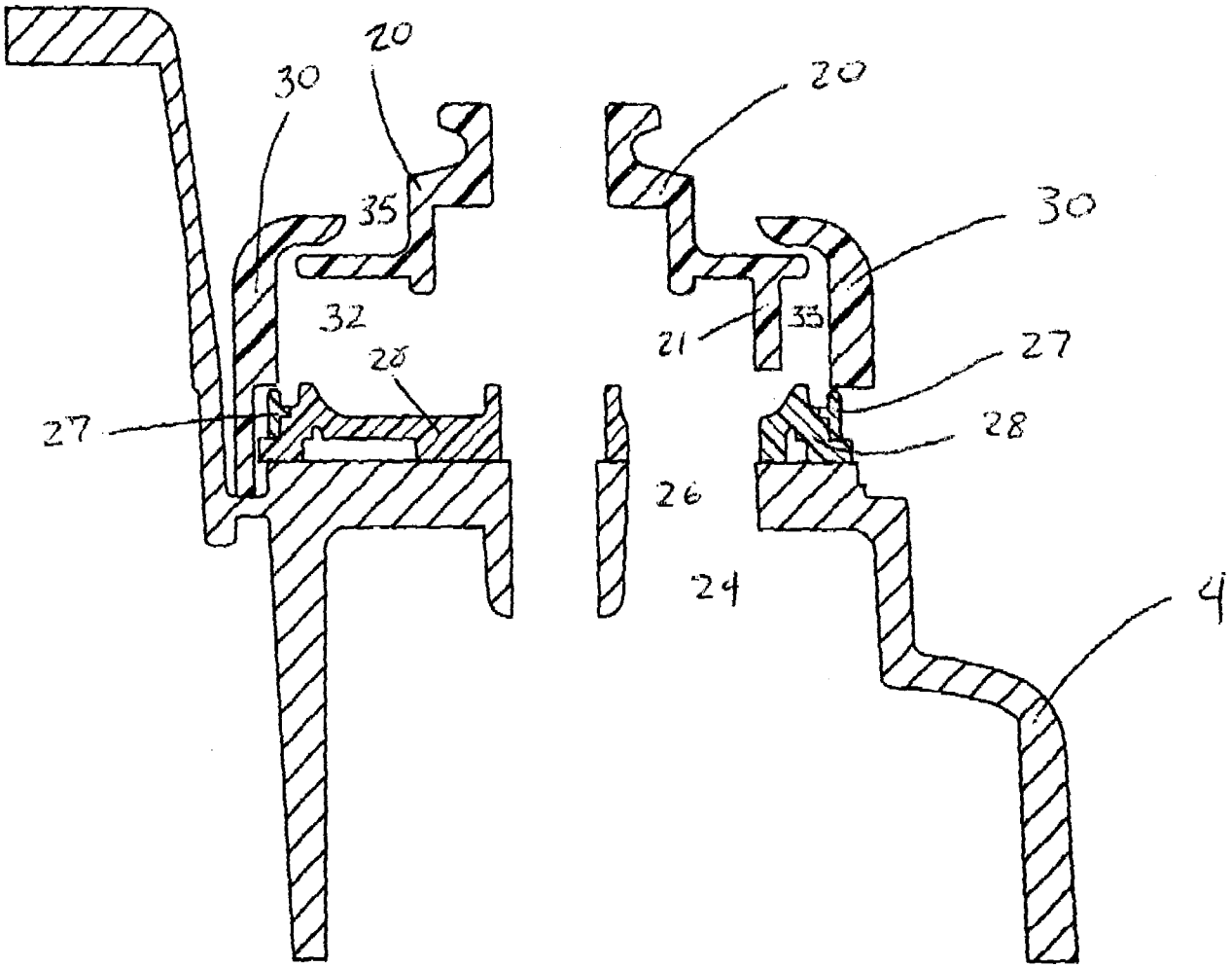
FIG. 14 is a cross section elevation view of the dust fan of FIG. 13.

With additional reference to FIGS. 5-7, the suction created by dust fan 20 pulls an air flow (indicated by arrows in FIG. 5) from the vicinity of drive wheel 9 through an air passage 22 cast into the right housing 3 and gear case 4. Upper portions of both the right housing 3 and gear case 4 define an inlet or suction chamber 24. The upper portion of gear case 4 also defines suction openings 26 in a trefoil arrangement. Rotatably mounted to the upper exterior portion of gear case 4 is an inlet or suction damper 28. Damper 28 has trefoil openings and a user operable switch or damper 29 for rotating the damper 28 between an open or "ON" position, wherein the suction openings 26 and damper openings are aligned, and a closed or suction "OFF" position, wherein the damper is unaligned and blocks the suction openings 26.

With further reference to FIGS. 8-14, on the exterior side of the gear case 4, dust fan 20 is rotatably and coaxially mounted with damper 28 and suction openings 26. Dust fan 20 includes a pulley portion 23, to which fan belt 18 is drivingly connected. Dust fan 20 is a radial type fan. That is, rotation of dust fan 20 creates a suction at its center and a pressure around its periphery, so that airflow is from the center radially outward through the fan vanes 21 to the periphery.

Mounted to the exterior of gear case 4 is fan enclosure 30 with fan 20 sandwiched in between. Fan enclosure 30 and gear case 4 define between them a fan chamber 31. Fan 20 divides fan chamber 31 into a radially inward suction/inlet chamber 32 and a radially outward discharge/outlet chamber 33. Fan enclosure 30 also defines a slot 34, through which damper switch 29 projects, and an opening 35, through which pulley portion 23 of fan 20 projects.

Figure 15:
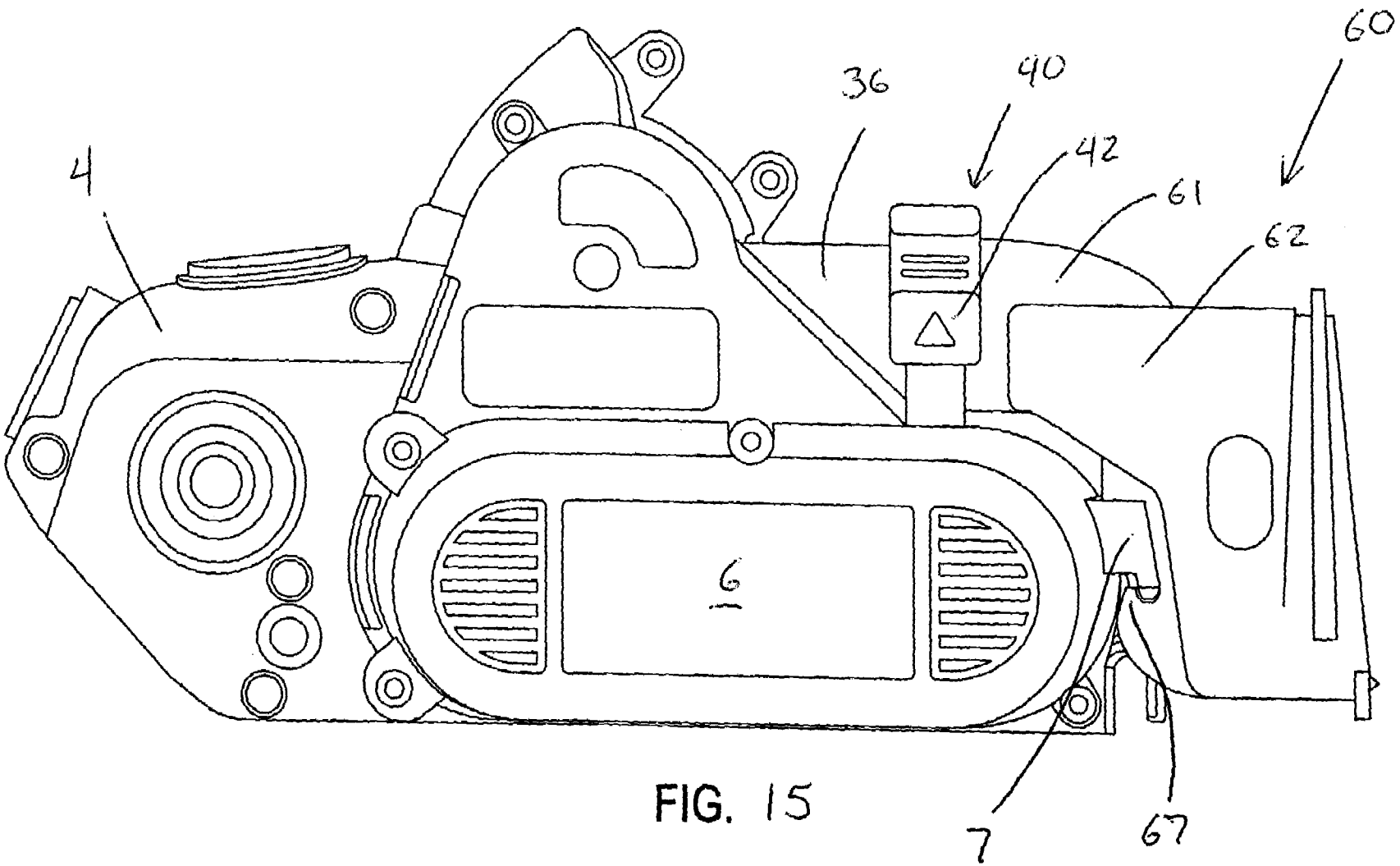
FIG. 15 is a simplified elevation view of portions of the belt sander of FIG. 1 with the addition of elements of the dust receptacle.

Referring now to FIG. 15, air and dust pulled through dust fan 20 exits discharge/outlet chamber 33 through outlet duct 36, which in the preferred embodiment is an integral portion of fan enclosure 30. The downstream end of duct 36 connects to the dust cassette 60 by means of a locking collar assembly 40. In the preferred embodiment, locking collar assembly 40 comprises a collar 42 movably mounted to the exterior of duct 36. Collar 42 is movable between a first locked position, wherein it secures the inlet 61 of the dust cassette 60 to the outlet of the duct 36, and a second unlocked position, wherein the dust cassette is detachable from the outlet duct 36.

The operation of the dust collection system will now be summarised. Motor 10 drives driven pulley 12 via drive belt 14. In turn, driven pulley 16 drives dust fan 20 via fan belt 18. Rotation of dust fan 20 creates a suction that pulls air and dust from the vicinity of rear drive wheel 9 through air passage 22 and into chamber 34. With damper 28 in the "ON" position, the air and dust is drawn through openings 26 and damper 28 and across fan 20. The air and dust is exhausted from the fan 20 through duct 36 and locking collar assembly 40 into the dust cassette 60. In the dust cassette 60 the dust is trapped while the air is filtered and exhausted across the air permeable sides.

If it is desired to disable the dust collection system, for example during outdoor use, this may be accomplished in two ways. First, the user may rotate the suction damper 28 to the "OFF" position. In the OFF position the dust fan 20 will continue to turn, but will not produce a suction in the vicinity of the rear drive wheel 9. Alternatively, the user may temporarily remove belt cover 6 from gear case 4, thus exposing the belts 14 and 18. Fan belt 18 may be removed from driven pulley 16 and pulley portion 23 of dust fan 20. With fan belt 18 removed, the dust fan 20 will not be turned and no airflow will be produced in any portion of the dust collection path.

For cost effective and practical assembly, dust fan enclosure 30 mounts to the gear case 4 over the suction damper 28. Between the enclosure 30 and damper 28 is a seal member 27. In the preferred embodiment shown in FIG. 14 seal member 27 is in the form of a flexible overmold bonded to the damper 28. The seal overmold 27 provides a sufficiently tight fit between enclosure 30 an damper 28 so as to limit air in leakage to the suction side of fan 20, while permitting relative rotation between damper and enclosure.

Figure 16:
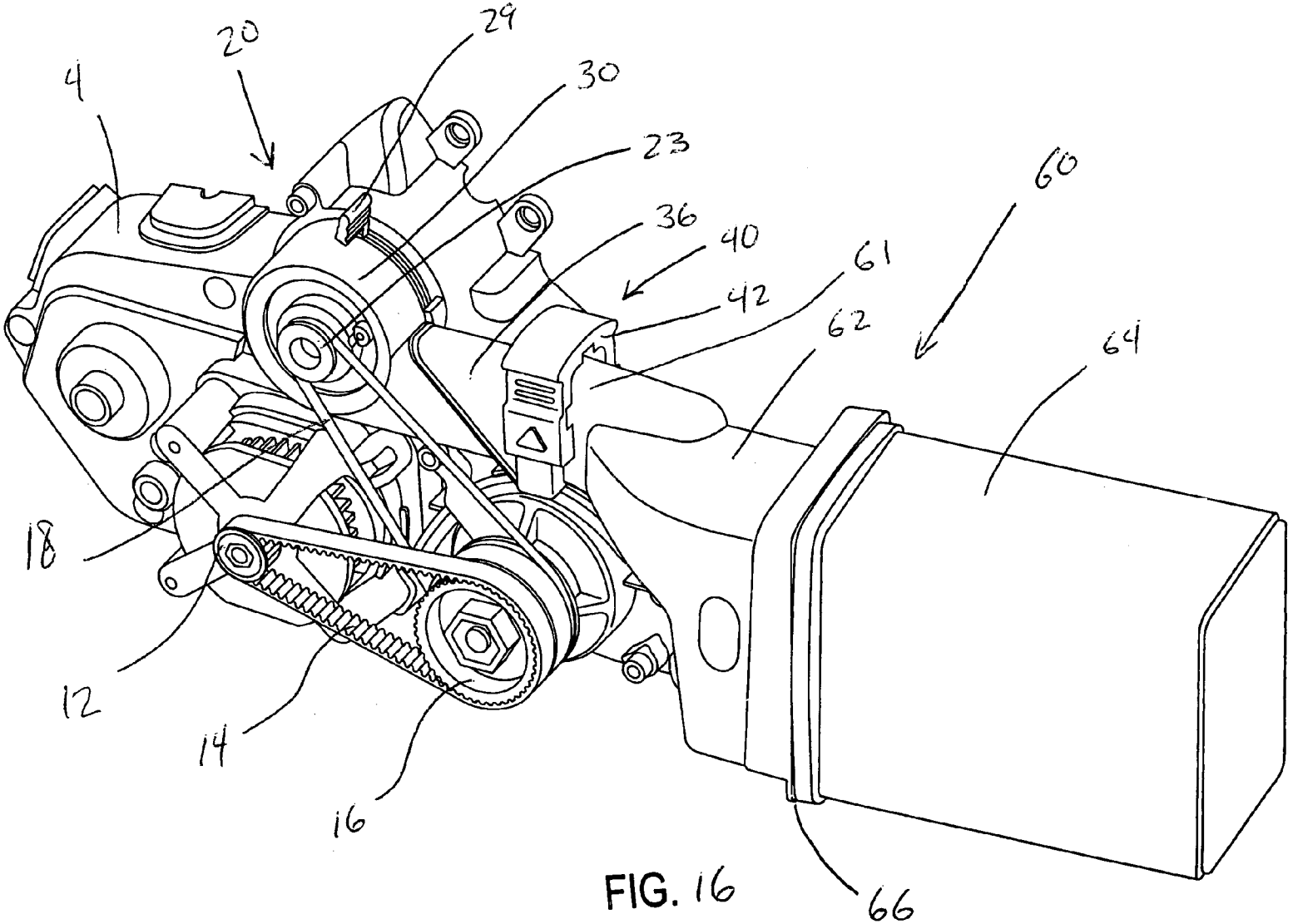
FIG. 16 is a perspective view of the belt sander and dust receptacle of FIG. 15 with additional elements added.
Figure 17:
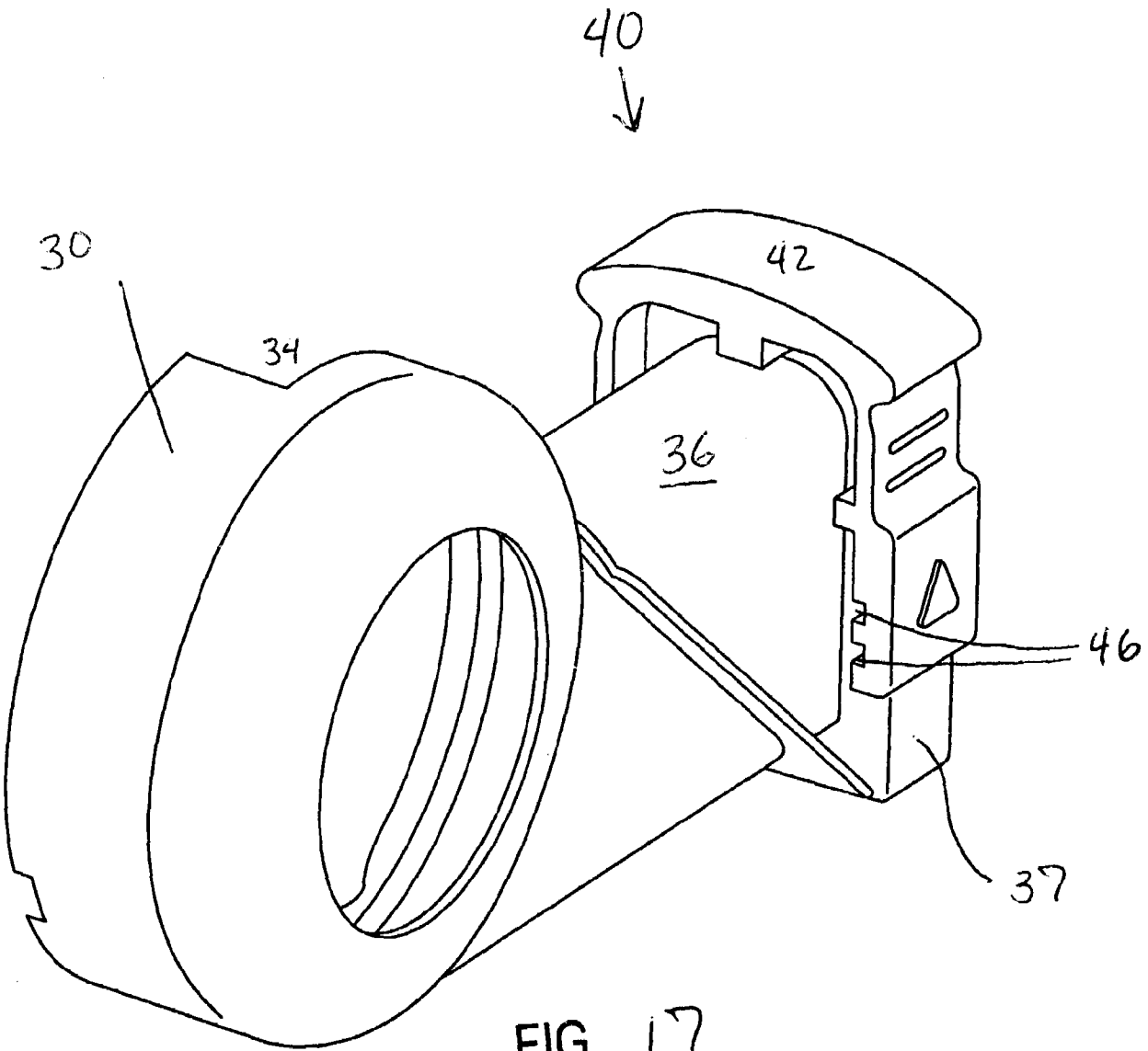
FIG. 17 is a perspective view of the dust fan enclosure and collar assembly of the FIG. 15.
Figure 18:
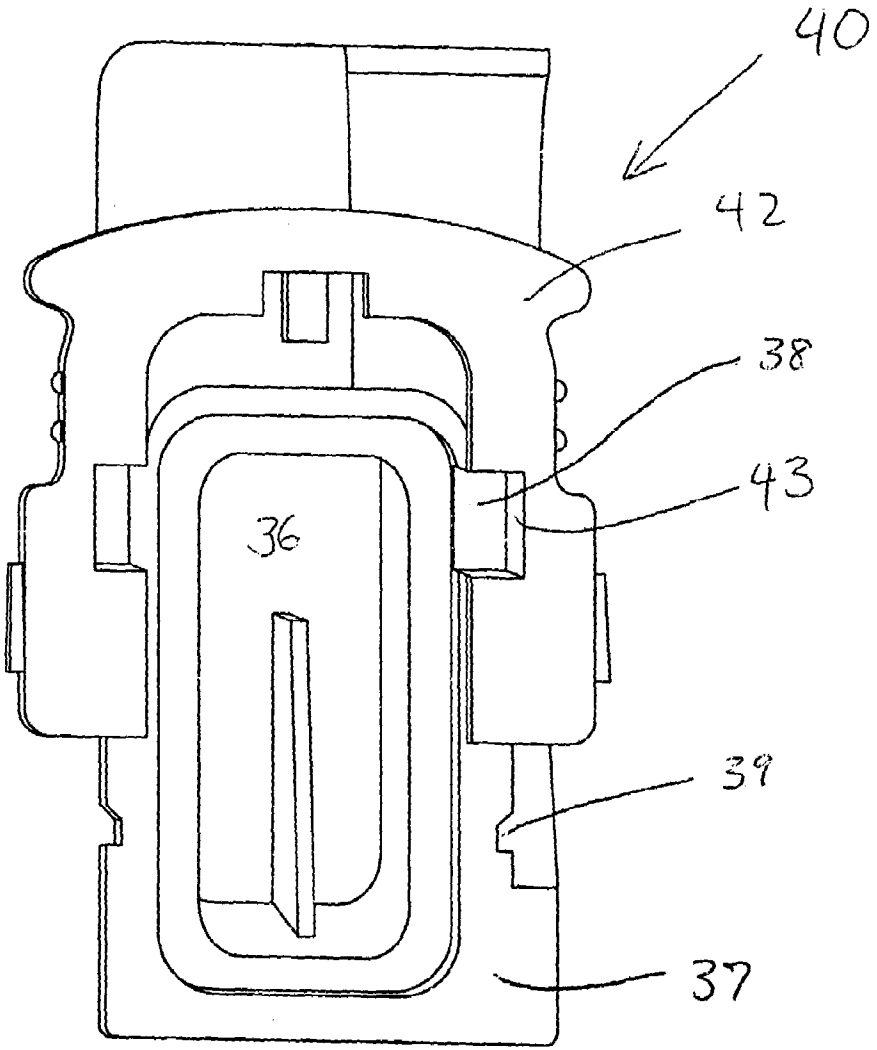
FIG. 18 is a rear end elevation view of the fan enclosure and collar assembly of FIG. 17.
Figure 19:
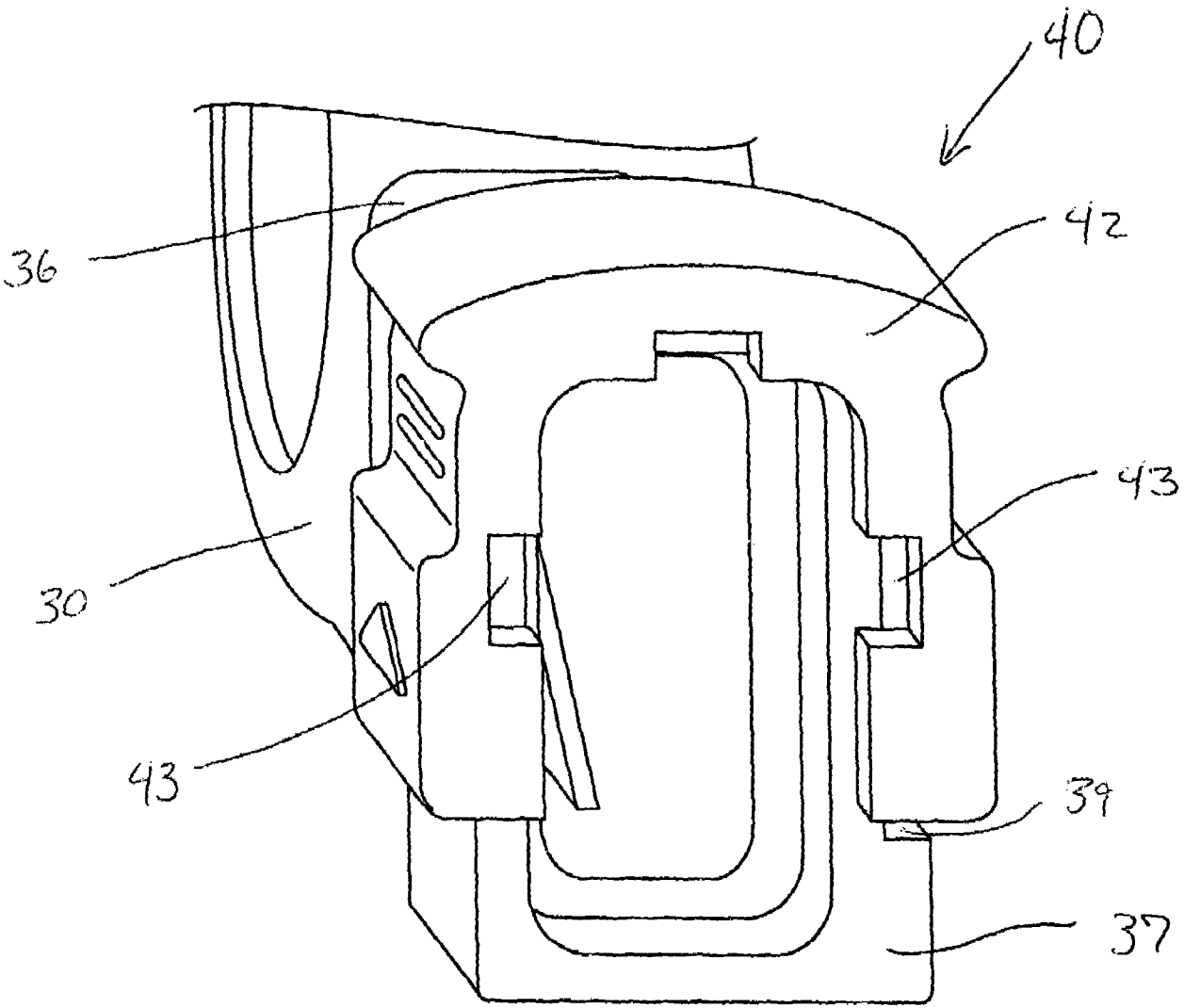
FIG. 19 is an alternative perspective view of the fan enclosure and collar assembly of FIG. 17.

With reference to FIGS. 15 and 16, in the preferred embodiment dust cassette 60 comprises a first part 62 and a second part 64. First part 62 is substantially funnel shaped as it expands from a small upstream/inlet end 61, connected to the exhaust duct 36 by means of the collar assembly 40, to a larger rectangular shaped downstream end 63. First part 62 is preferably semi-rigid, that is slightly flexible, so that it may be deformed for ease of installation and connection. In one preferred embodiment, first part 62 may be made of Santoprene® or another rubber-like material. Second part 64 is an air permeable fabric skin over a rigid frame 80.

Air and dust from the dust fan 20 flows through the exhaust duct 36 into the first part 62 of dust cassette 60 and then into the second part 64. Dust is trapped inside the dust cassette 60, but the air is filtered through the air permeable sides of second part 64 and thus exhausted. When the dust cassette 60 is substantially full of dust it can be quickly emptied by breaking the connection 66 between the first part 62 and the second part 64. Depending on the circumstances, it may first be necessary to disconnect the entire dust cassette 60 from the sander at the collar assembly 40.

With particular reference to FIGS. 15-20, the connection between the dust cassette 60 and the sander will be described in further detail. First part 62 of cassette 60 comprises a flexible clip 67 and an inlet end 61. To attach the dust cassette 60 to the sander, flexible clip 67 hooks onto and grips a flange 7 located on the rearward end of belt cover 6. Simultaneously, inlet end 61 is inserted into the locking collar assembly 40. The simultaneous alignment of the clip 67, flange 7, inlet end 61, and locking collar assembly 40 is made easier by the flexible material of first part 62, which the user can deform in older to make the two connections.

Inlet end 61 includes two protruding ribs 69. With collar 42 in the second/unlocked position, inlet end 61 is fit into the collar assembly 40 so that ribs 69 are inserted through and past cutouts 43 in collar 42 and fit into recesses 38 defined in the outlet end flange 37 of the outlet duct 36. Collar 42, which slidably engages end flange 37, can then be slid down to its first position, wherein collar 42 traps ribs 69 within recesses 38, thus locking inlet end 61 in collar assembly 40. Mating detent structures 39 on flange 37 and 46 on the collar 42 restrain the collar in either of the locked or unlocked position, unless overcome by the force of the user deliberately moving the collar.

Figure 20:
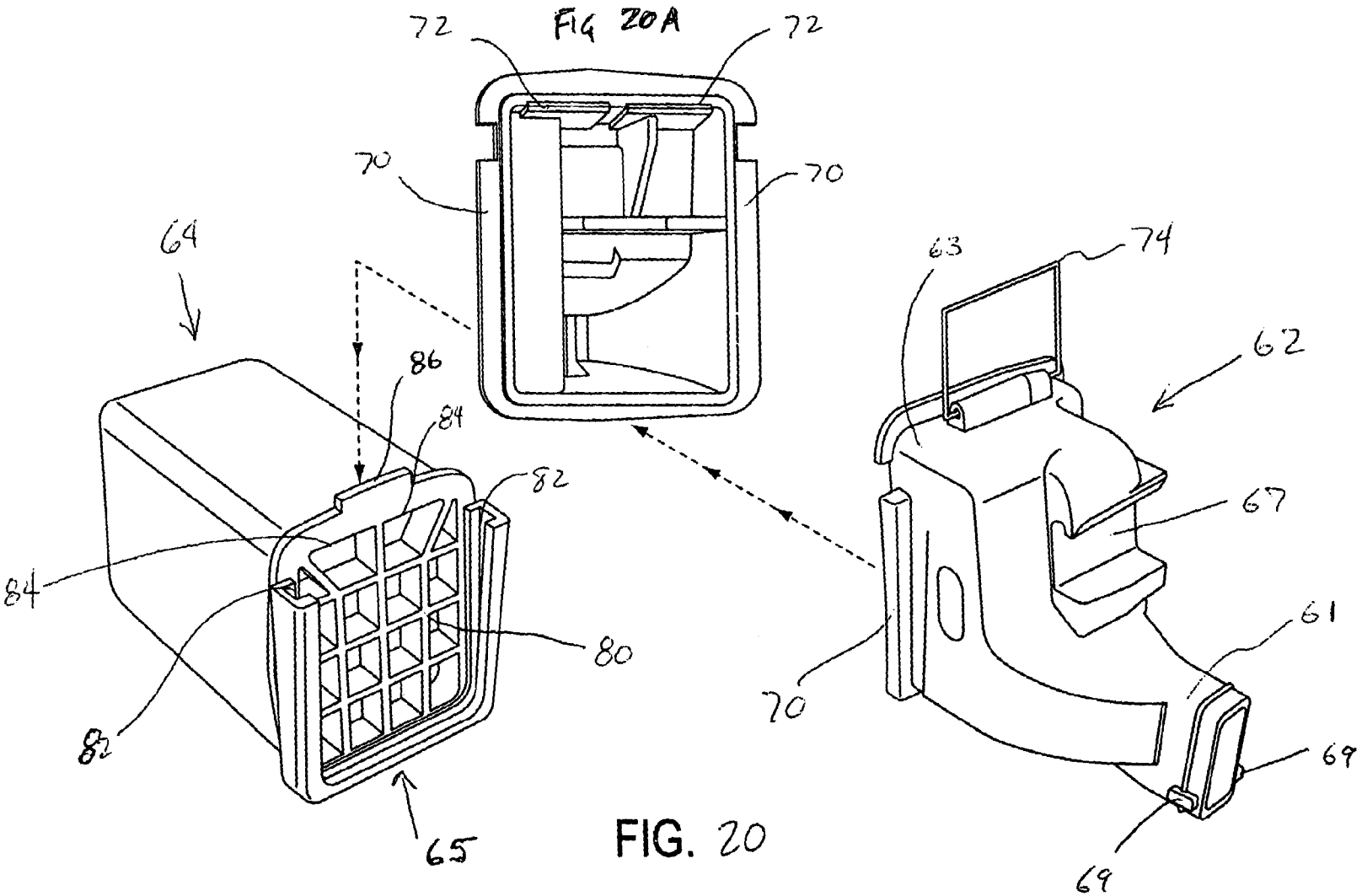
FIG. 20 is an exploded perspective view of the dust receptacle of the belt sander of FIG. 16.

With particular reference to FIG. 20 (wherein the dust cassette is shown inverted from its attached/in-use orientation), the construction of the dust cassette 60 will be described in greater detail. The second part 64 of the dust cassette 60 is a dust bag/box constructed as an air permeable fabric stretched over a rigid frame 80 in the known way. In the preferred embodiment second part 64 is substantially a rectangular solid and open at one side 65. At open end 65 frame 80 defines opposed slots 82 on opposite sides of the open end and an upper lip 84.

The downstream end 63 of first part 62 (shown in the facing view 20A) includes a flange 70 and flexible tabs 72. A hook 74 is pivotably attached to first part 62 proximate to the downstream end.

To connect the parts of the dust cassette 60, the flange 70 of first part 62 is slid into slots 82 of frame 80 of the second part 64 until open side 65 of the second part is aligned with the downstream end 63 of the first part. When so aligned, flexible tabs 72 on first part 62 will detent underneath lip 84 of the second part 64 to secure the first part and second part together. Additional security is provided by the hook 74 on first part 62, which can be pivoted to engage a latch 86 on the second part 64.

Disconnecting of the two parts 62 and 64 is made easier by the flexible construction of the first part. After unlatching hook 74, the user can squeeze and deform first part 62 so as to undo the detent between tabs 72 and lip 84. Then flange 70 may be readily slid out of slots 82.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

The invention claimed is:

1. An electrically powered belt sander comprising:

a housing;

a motor mounted in the housing at a first location and having an output shaft;

a dust collection fan rotateably mounted in the housing at a second location a distance from the motor output shaft;

a drive roller mounted in the housing;

a first transmission between the motor output shaft and the drive roller; and a second transmission between the motor output shaft and the dust collection fan the second transmission selectably disconnectable for preventing rotation of the dust collection fan without disconnecting the first transmission to the drive roller.

2. The electrically powered belt sander of claim 1 wherein the second transmission includes a pair of intermeshing gears for driving the fan in rotation.

3. The electrically powered belt sander of claim 1 wherein the second transmission includes a belt for driving the fan in rotation.

4. The electrically powered belt sander of claim 1 further comprising:

a dust flow path defined by the housing; and a damper located in the dust flow path and operable for blocking the dust flow path.

5. The electrically powered belt sander of claim 1 further comprising:

a driven roller rotareably mounted in the housing and having a first axis and;

the drive roller has a second axis substantially parallel to the first axis; and wherein the first axis and the second axis lie in a plane, and the motor has an axis, which motor axis is substantially parallel to the first axis and lies approximately in the plane of the first and second axis.

6. The electrically powered belt sander of claim 1 wherein the second transmission includes:

a drive pulley mounted on the motor output shaft;

a pulley mounted to the fan; and a belt driveably connecting the drive pulley to the fan pulley.

7. The electrically powered belt sander of claim 1 wherein the second transmission includes:

a drive pulley mounted on the motor output shaft;

a pulley mounted to the fan;

a third pulley;

a first belt driveably connecting the drive pulley to the third pulley; and a fan belt driveably connecting the third pulley to the fan pulley.

8. The electrically powered belt sander of claim 1 wherein the fan is a radial fan.

9. The electrically powered belt sander of claim 4 wherein the damper is located on the suction side of the fan.

10. The electrically powered belt sander of claim 4 further including a flexible seal member attached to the damper.

11. The electrically powered belt sander of claim 4 wherein the damper is rotateable from a first position, wherein the dust flow path is blocked. to a second position, wherein the dust flow path is not blocked.

12. A method of disabling the dust collection air flow of an electrically powered portable belt sander for sanding operation without dust collection, said method comprising the steps of:

providing a portable belt sander including a motor, a drive roller driven by the motor via a first drive belt, and a dust collection fan driven by the motor via a second drive belt, and disconnecting the second drive belt.

13. An electrically powered belt sander comprising:

a housing having a first end and a second end and defining a dust collection air flow path;

a first roller assembly mounted in the housing proximate the first end of the housing;

a second roller assembly mounted in the housing proximate the second end of the housing and including a driven pulley, the driven pulley including a first portion and a second portion;

an abrasive belt mounted around the first roller and the second roller and defining a loop;

a motor mounted in the housing between the first roller and the second roller and within the loop of the abrasive belt, the motor including an output shaft bearing a drive pulley;

a radial dust collection fan rotatably mounted in the housing above the loop of the abrasive belt and within the dust collection air flow path, the fan including a suction center, a discharge volute, and a pulley portion;

a first drive belt mounted around the drive pulley and the first portion of the driven pulley;

a second drive belt mounted around the second portion of the driven pulley and the pulley portion of the dust collection fan; and a damper integrally and rotatably mounted in the housing and located in the dust flow path on the suction side of the dust collection fan and selectably movable from a first installed position, wherein the dust flow path is blocked, to a second installed position. wherein the dust flow path is not blocked, the damper including a switch extending thorough a slot in the housing, and the switch is user operable for rotating the damper between the first position and the second position.

* * * * *